United States Patent [19]

Rosendahl et al.

[11] 3,958,871

[45] May 25, 1976

[54] COMPOSITE POLARIZED FILM FOR USE IN A WEAPON TRAINING SIMULATOR

[75] Inventors: Gottfried R. Rosendahl; Windell N. Mohon, both of Winter Park, Fla.

[73] Assignee: The United States of America as represented by the Secretary of the Navy, Washington, D.C.

[22] Filed: June 20, 1975

[21] Appl. No.: 588,987

[52] U.S. Cl. ..... 352/39; 35/25; 352/132

[51] Int. Cl.[2] ..... G03B 19/18

[58] Field of Search ..... 352/38, 39, 45, 132; 35/25

[56] References Cited

UNITED STATES PATENTS 3,911,598 10/1975 Mohon ..... 35/25

*Primary Examiner*—Monroe H. Hayes

*Attorney, Agent, or Firm*—Richard S. Sciascia; John W. Pease

[57] ABSTRACT

A method of making and utilizing a composite three layer specially polarized motion target film for gunnery practice in which two vectograph films of 90° variance in polarization and a black and white film comprise the composite film and are prepared by image transfer from a normal color movie film of a real world scene including background and target areas made with the target areas painted a color uncommon to the colors in the background. The method includes filtering out background and target areas respectively in image transfer to the respective vectograph films and in utilizing a filter rendering an appropriate gray value to the uncommon color target areas in the image transfer to the black and white film to cause the uncommon color targets to blend in with the background properly in the image obtained from the composite film. The result obtained is a complete motion picture film plus target areas, visible and invisible, of 90° out of phase polarization, which targets are distinguishable by a polarizing filter and light receiver and hit indicator circuit provided on a weapon to be aimed at the target.

4 Claims, 7 Drawing Figures

COMPOSITE POLARIZED FILM FOR USE IN A WEAPON TRAINING SIMULATOR

CROSS-REFERENCE TO RELATED PATENTS

This application is related to the copending U.S. application Serial No. 588738.

BACKGROUND OF THE INVENTION

The invention relates to the arts of optics and electronics in the field of simulation and has a particular reference to gunnery training via simulation and without the requirement of live ammunition.

A past and continuing need exists to train military in simulated combat conditions in a safe, low-cost manner without the requirement of live ammunition.

Recently, simulators have been developed utilizing lasers and target associated detectors in weapon fire simulation systems. Lasers, retroreflective targets and weapon mounted laser beam detectors have also been used in weapon fire simulation systems.

SUMMARY OF THE INVENTION

This invention is directed to a form of movie film which will provide for use in a universal weapons trainer where any condition can be programmed and wherein there is immediate feedback in real time to the trainee of his performance at minimum film cost and improved realism. In this respect three films are formed from one normal color film of a real life scene in which a target such as a tank is painted an uncommon color, such as a red, i.e., uncommon in relation to the prevailing background area colos, and with the use of red blocking and red pass filters transfer of the color film images is made to second and third vectograph films to obtain an X° and X° + 90° relationship of the background and target such that one can use the X° + 90° polarized target as a lead or aiming point and the use of a polarizing filter to distinguish between the polarized target and the background area. The background area will include a visible target, an invisible lead target such that in aiming a weapon, if correctly held, the weapon will be directed at the X° + 90° polarized target and a hit will be scored. Suitable indexing of film frames provide the desired lead. The fourth film of the composite combination is a black and white film which by appropriate filtering in transfer of image from the original color film to the fourth film gives the appropriate gray value to the uncommon, as for example red, color target area or areas.

DESCRIPTION OF THE PREFERRED EMBODIMENT

Figure 1:
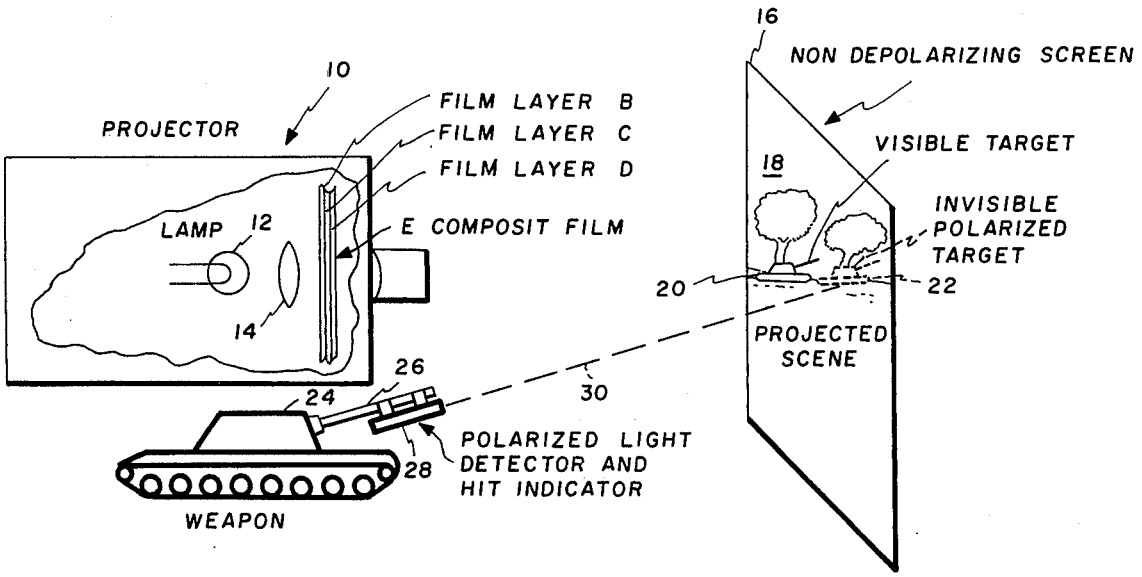
FIG. 1 is a schematic view of a gunnery training simulator embodying the invention.

Referring to the drawing in FIG. 1 is shown a gunnery weapons trainer simulator incorporating the invention. In FIG. 1 a projector 10 having a lamp 12 and optical system represented by lens 14 is loaded with a specially prepared composite film E comprising the film layers B, C and D, the composition of which will be described in detail hereinafter. The film E is composed such that it will project on a non-depolarizing screen 16, a background scene 18 including a visible target tank 20 all of one polarization of X° and an invisible target 22 of polarization X° + 90°.

A weapon 24 having a barrel 26 has attached to the barrel a polarized light detector and hit indicator electronic systm 28 which is directed in training the weapon 24 to receive a light input, i.e., dotted line 30, from the invisible polarized target 22 when the weapon is correctly leading the visible target 20.

Figure 2:
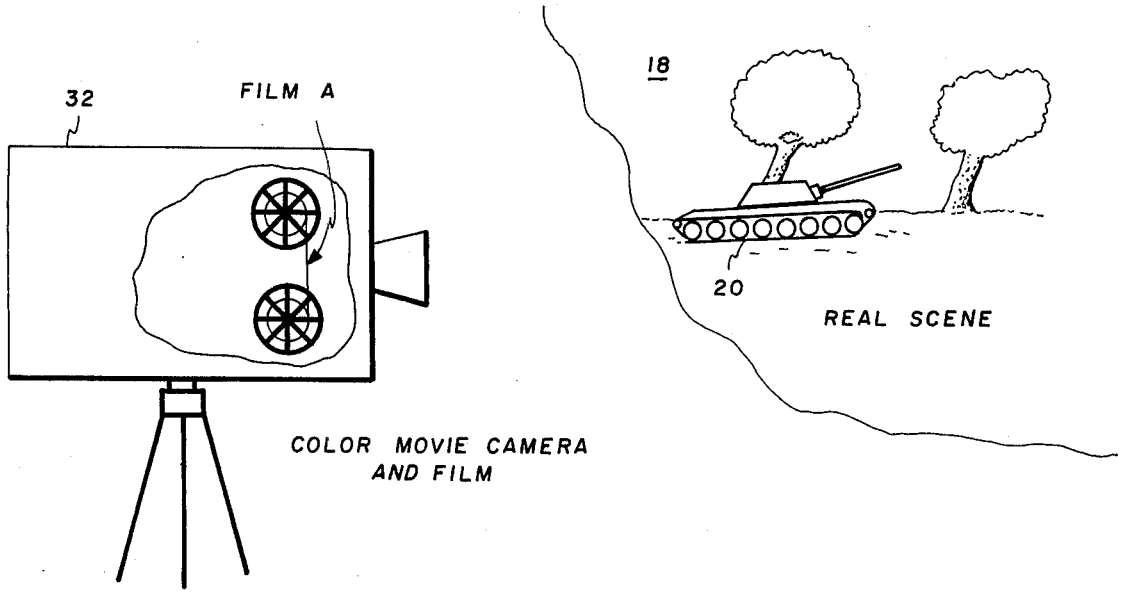
FIG. 2 is a schematic illustrating the exposure and making of the first color movie of a real life scene with the target area made an uncommon color in relation to the background area.

The above describes the general environment, apparatus and system, in which the invention is incorporated. Attention is now directed to the several steps by which the composite film E is produced. Initially, as shown schematically in FIG. 2 and in accordance with the invention, a first normal color movie film A is made of a real world scene including background 18 and target 20 areas and in which the target 20 (or targets) is painted a color uncommon to the colors of said background. Note that we are talking not of an uncommon color in the sense of odd, but uncommon in the sense that it is a color not in the colors of the background area. One example has been the use of red where red was not found in the background area. Thus, in FIG. 2 the tank 20 would be painted red and the color film A loaded in a camera 32 is exposed to record the real life scene.

Figure 3:
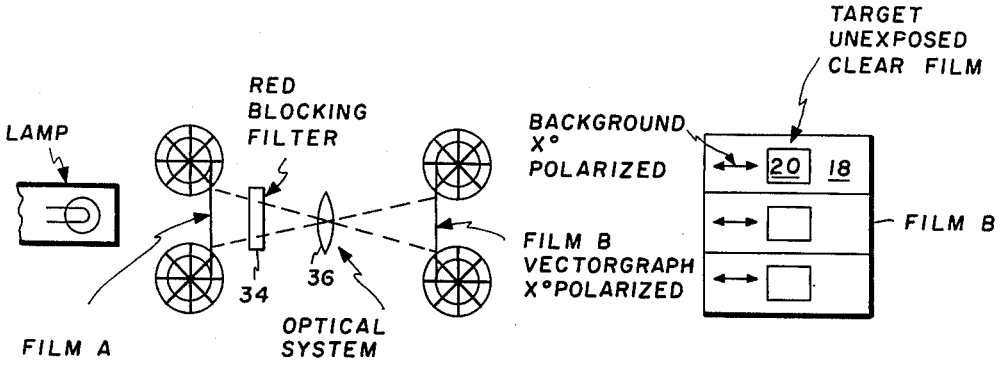
FIG. 3 is a schematic illustrating the transfer of the background scene to a X° polarized film.

Thereafter, as shown in FIG. 3 the scene image is transferred to a second film B of vectograph type which is polarized X° while using a blocking filter 34 for said uncommon color (a red blocking filter for example) between the films A and B such that only the background scene 18 is passed to said second film B, the unexposed target area 20 appearing clear as indicated in the three film frames of film B in FIG. 3. Film B then provides the background scene with polarization of X° represented by the horizontal arrow indicated. The optical system in FIG. 3 is indicated by lens 36.

Figure 4:
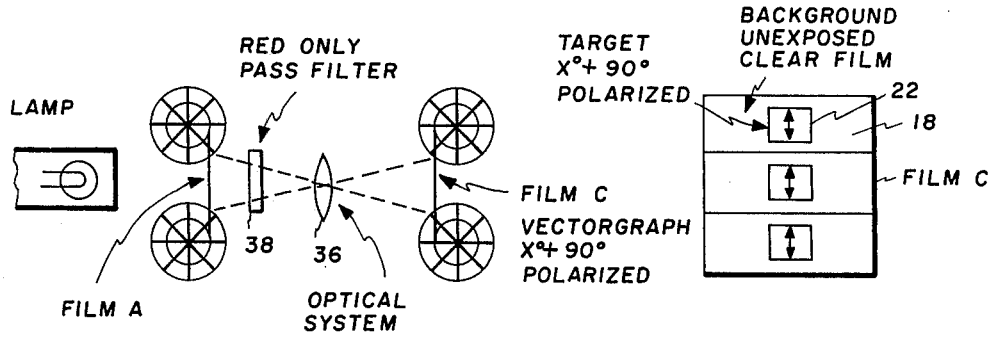
FIG. 4 is a schematic illustrating the transfer of the target only area to an X° + 90° polarized film.

Referring to FIG. 4, to now provide the target area of the scene and have it at X° + 90° polarization the original scene is now transferred from first film A to a third film C of the vectograph type while using a filter 38 which passes only said uncommon color to render the target area 22 of image density and the background area 18 clear. This third film is selected of a type which polarizes upon exposure to a direction 90° from that of said second polarizing film or X° + 90°. Now between films B and C we have the complete scene with films of 90° difference in polarization.

Figure 5:
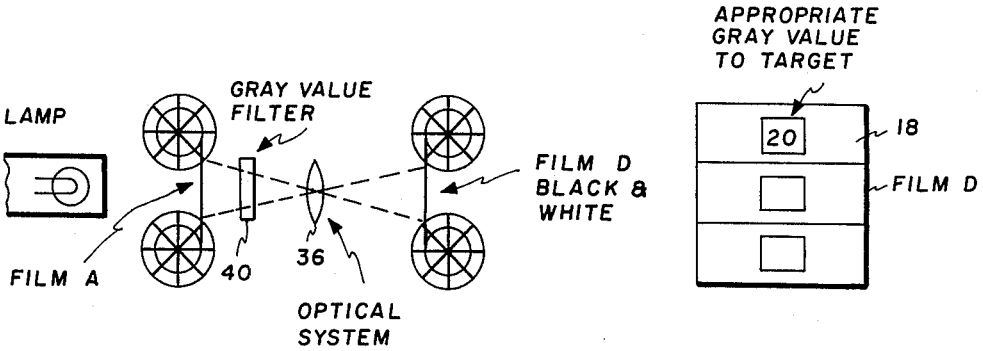
FIG. 5 is a schematic illustrating the transfer of the original color movie scene to a black and white film with an appropriate gray value filter to provide an appropriate gray value to the target area.

Referring to FIG. 5, to now provide for the visible target area 20, the image of the original live scene is transferred from color film A to a fourth, black and white, film D while using a filter 40 rendering the appropriate gray value to the uncommon color target area to remove the uncommon color target from the scene and cause it (or them) to blend in with the background properly as indicated in the film frames shown in FIG. 5.

Films B and C, i.e., the second and third films, are then fixed together in registration such that when projected in composite with film D as a three layered composite movie film E, the target and background scenes 20 and 18 respectively are totally linearly polarized but in respective 90° out of phase relation.

Further, in order to detect the invisible polarized target area 22, we provide the polarized light detector and hit indicator unit 28 which receives its activating input via light ray 30, FIG. 1.

We have not mentioned the registered or non-registered relationship of film D to films B and C because the system will work beneficially under either condition. However, with moving targets one normally needs a lead in properly training the weapon to hit the actual target. Hence, the film D is placed in selected degree of non-registration with films B and C to provide the lead position for target 22 in relation to target 20 as shown in FIG. 1.

Figure 7:
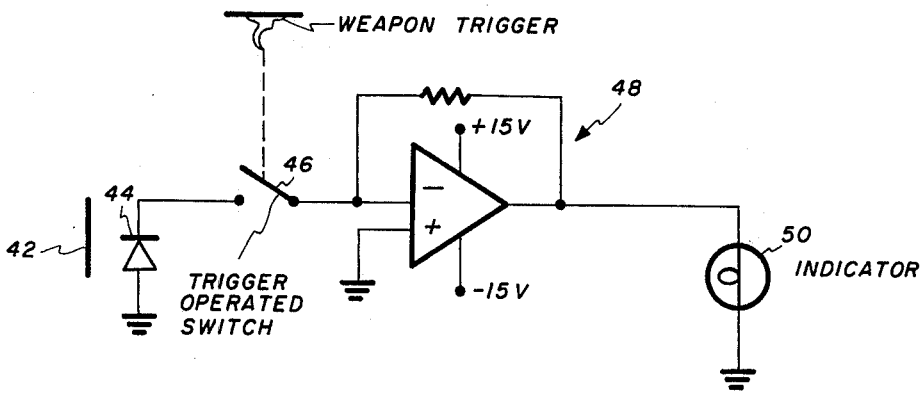
FIG. 7 illustrates one suitable electronic circuit as a detector receiver circuit and hit indicator.

Any suitable system can be applied as a polarized light detector-hit indicator system. One suitable example is shown in FIG. 7 wherein an X° + 90° polarization pass filter 42 is positioned in front of a light detector such as photo diode 44 which is connected through a weapon trigger operated switch 46 and an operational amplifier, generally indicated at 48, of suitable watts rating and gain to operate an indicator 50 shown as a light but which could be audio (horn), visual (bulb), or recording (counter).

Figure 6:
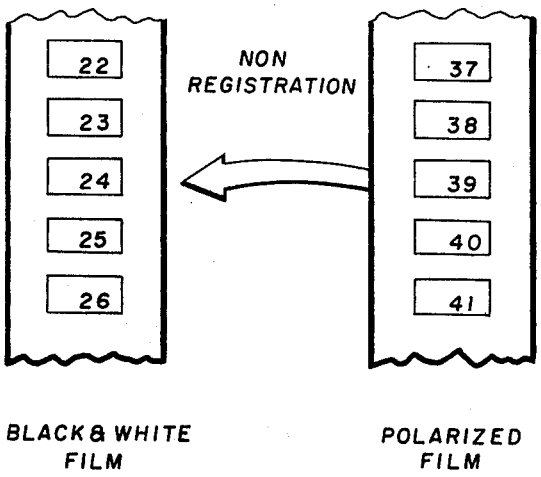
FIG. 6 illustrates the relative indexing of the polarized and black and white films to provide a suitable target lead.

FIG. 6 is provided to show the non-registered relationship of the black and white film D and the polarized target film B and C when required to provide lead for a moving target condition.

The system and apparatus as thus described has several advantages which include the fact that no hand animating of the target film is required. It is all done rapidly by image transfer. Further, it is more reliable and more easily maintained than methods which would require slaving a detector spot to a target.

What is claimed is:

1. A method of making and utilizing a specially polarized motion target film for gunnery practice comprising:

a. the step of making a first normal color movie film of a real world scene including background and target areas and in which all targets therein are painted a color uncommon to the colors of said background;

b. the step transferring the scene to a second film of the vectograph polarizing type while using a blocking filter for said uncommon color between the films in the transfer such that only the background scene is passed to said second film, the unexposed target areas appearing clear;

c. the step of again transferring the scene from said first film to a third film of the vectograph type while using a filter which passes only said uncommon color to render the target areas of image density and the background clear, said third film being of a type which polarizes upon exposure to a direction 90° from that of said second polarizing film;

d. the step of again transferring the scene from said first film to a fourth black and white film while using a filter rendering the appropriate gray value to the uncommon color target areas to remove the uncommon color targets from the scene and cause them to blend in with the background properly;

e. the step of fixing together in registration said second and third and fourth films such that when projected as a three layered movie film the targets and background scenes are totally linearly polarized but in respective 90° out of phase relation; and f. the step of utilizing a polarizing filter on a weapon affixed detector and in such position that it coincides with the target polarization and passes light that is linearly polarized from the targets when the weapon is trained on the non-visible polarized target.

2. The method according to claim 1 including:

a. the step of arranging said fourth film in selected non-registration in relation to said second and third films to provide a desired lead of said polarized target over said non-polarized visual target.

3. The method according to claim 1 wherein:

a. said uncommon color is red.

4. The method according to claim 2 wherein:

a. said uncommon color is red.

* * * * *